US007713039B2

(12) United States Patent
Achtelik et al.

(10) Patent No.: US 7,713,039 B2
(45) Date of Patent: May 11, 2010

(54) HELICAL SCREW COMPRESSOR HAVING A VENTED SEALING ARRANGEMENT

(75) Inventors: Carsten Achtelik, Dinslaken (DE); Dieter Hüttermann, Hünxe (DE); Michael Besseling, Hünxe (DE); Norbert Henning, Müheim (DE)

(73) Assignee: GmbH Rand Schraubenkowpressoren GmbH, Oberhausen (DE)

( * ) Notice: Subject to any disclaimer, the term of this patent is extended or adjusted under 35 U.S.C. 154(b) by 0 days.

(21) Appl. No.: 12/094,388

(22) PCT Filed: Jun. 9, 2006

(86) PCT No.: PCT/EP2006/005559

§ 371 (c)(1),
(2), (4) Date: May 20, 2008

(87) PCT Pub. No.: WO2007/065487

PCT Pub. Date: Jun. 14, 2007

(65) Prior Publication Data

US 2009/0004036 A1 Jan. 1, 2009

(30) Foreign Application Priority Data

Dec. 8, 2005 (DE) ..... 10 2005 058 698

(51) Int. Cl.
*F03C 2/00* (2006.01)
*F03C 4/00* (2006.01)
*F04C 2/00* (2006.01)

(52) U.S. Cl. ..... 418/95; 418/9; 418/85; 418/98; 418/104; 418/201.1

(58) Field of Classification Search ..... 415/95, 415/98–100, 104, 201.1, 85, 88, 9, 15
See application file for complete search history.

(56) References Cited

U.S. PATENT DOCUMENTS

| | | | |
|---|---|---|---|
| 2,849,988 | A | 9/1958 | Nilsson |
| 3,138,320 | A | 6/1964 | Schibbye et al |
| 4,076,468 | A | 2/1978 | Persson et al. |
| 4,153,395 | A | 5/1979 | O'Neill |
| 4,487,563 | A | 12/1984 | Mori et al. |
| 4,767,284 | A | 8/1988 | Shiinoki et al. |

(Continued)

FOREIGN PATENT DOCUMENTS

| | | | |
|---|---|---|---|
| DE | 1147443 | B | 4/1963 |

(Continued)

*Primary Examiner*—Theresa Trieu
(74) *Attorney, Agent, or Firm*—Michael Best & Friedrich LLP

(57) ABSTRACT

A helical screw compressor includes two rotors which are mounted in the rotor housing. The helical screw compressor includes sealing arrangements (11, 11') for sealing the pressure-sided shaft journals of the rotors. Each sealing arrangement includes a plurality of annular seals (11*a*, 11*b*) which are arranged in a row adjacent to each other, and an annular-shaped discharge chamber (51) is associated with the system on an intermediate position and is connected, via a discharge channel (53), to the chamber in the rotor housing, wherein pressure which is higher than the atmospheric pressure. Preferably, the discharge channel is connected to the suction chamber (10) of the rotor housing (1), and is impinged upon by precompressed gas from an upstream compressor step.

11 Claims, 4 Drawing Sheets

U.S. PATENT DOCUMENTS

| | | | | |
|---|---|---|---|---|
| 4,781,553 | A * | 11/1988 | Nomura et al. | 418/104 |
| 4,984,974 | A | 1/1991 | Naya et al. | |
| 5,836,753 | A * | 11/1998 | Takei et al. | 418/95 |
| 6,287,100 | B1 * | 9/2001 | Achtelik et al. | 418/104 |
| 6,416,302 | B1 * | 7/2002 | Achtelik et al. | 418/95 |
| 6,478,560 | B1 | 11/2002 | Bowman | |
| 6,572,354 | B2 | 6/2003 | Kammhoff et al. | |
| 2002/0081213 | A1 | 6/2002 | Takahashi et al. | |

FOREIGN PATENT DOCUMENTS

| | | | |
|---|---|---|---|
| DE | 1628201 | | 1/1972 |
| DE | 29922878 | U1 | 5/2001 |
| EP | 0582185 | A | 2/1994 |
| EP | 0959251 | A1 | 11/1999 |
| EP | 0993553 | A1 | 4/2000 |
| EP | 1163452 | A1 | 12/2001 |
| GB | 1335025 | | 10/1973 |
| JP | 11223191 | A | 8/1999 |
| WO | 9957440 | A1 | 11/1999 |

* cited by examiner

HELICAL SCREW COMPRESSOR HAVING A VENTED SEALING ARRANGEMENT

RELATED APPLICATION DATA

This application claims priority from German Patent Application No. 10 2005 058 698.8, filed Dec. 8, 2005, and PCT Application No. PCT/LP2006/005559, filed Jun. 9, 2006, both of which are incorporated by reference herein.

BACKGROUND

The invention pertains to a screw compressor with the features indicated in the preamble of claim 1.

Screw compressors of this type are known from EP 0 993 553 B1 and EP 1 163 452 B1, for example. In these references, a vent channel that is open to the atmosphere is connected to the relief chamber of the sealing arrangement.

The present invention has particular advantages when applied to a screw compressor that compresses a gaseous medium such as air to very high pressures, for example in the range of 30 to 50 bar, and in particular where the application involves the high pressure stage of a two or three stage compressor system. The invention relates to such a multi-stage screw compressor system, in particular a three-stage screw compressor system.

Due to the high compression in the compressor, the sealing arrangements that seal the pressurized side of the rotor shafts in the rotor housing are subjected to a very high pressure load. Even if the sealing arrangement consists of a large number of sequentially arranged seal rings, the pressure drop across the entirety of the sealing arrangement is not even, but rather it occurs primarily at the seal rings located external to the rotor, i.e. the farthest ones from it. Consequently, they are subjected to a higher mechanical load.

The object of the invention is to construct the sealing arrangement on the pressurized side of the shaft of a screw compressor of the type indicated such that the pressure drop along the sealing arrangement can be controlled and smoothed out so that the reliability of the seal can be improved, especially for very high final pressures in the screw compressor.

The solution to this objective is indicated in claim 1. The dependent claims refer to further advantageous features of the invention.

According to the invention, it was found that by providing a defined intermediate pressure at a defined intermediate position in the sealing arrangements on the pressurized side of the rotor shafts, the pressure in the sealing arrangement drops in a controlled, even manner. The result is an especially effective and reliable seal, and the minimization of pressure losses as a result of gas leakage.

SUMMARY

In one construction, the invention provides a screw compressor with a rotor housing (1) in which two screw rotors (3, 5) are rotatably held with parallel axes. The rotors mesh into one another with screw-shaped ribs and grooves and which convey a gaseous medium during operation, in particular air, from a suction-side end toward a pressurized end of the rotors, thereby compressing it, wherein each of the rotors has a shaft pin (7*a*, 7*b*, 9*a*, 9*b*) at its suction-side end and its pressure-side end, respectively. The pins are held in the rotor housing (1) by means of bearings (13, 15) and are sealed by means of respective sealing arrangements. The sealing arrangement (11, 11') of each pressure-side shaft pin has an annular relief chamber (51) to which a vent channel (53) is connected. The screw compressor characterized in that the vent channel (53) connects the relief chamber (51) to a chamber (10) within the screw compressor in which a pressure exists during operation of the screw compressor that is higher than atmospheric pressure but lower than the outlet pressure of the screw compressor.

BRIEF DESCRIPTION OF THE DRAWINGS

One embodiment of the invention is explained in more detail with the help of the drawings. Shown are.

DETAILED DESCRIPTION

Figure 1:
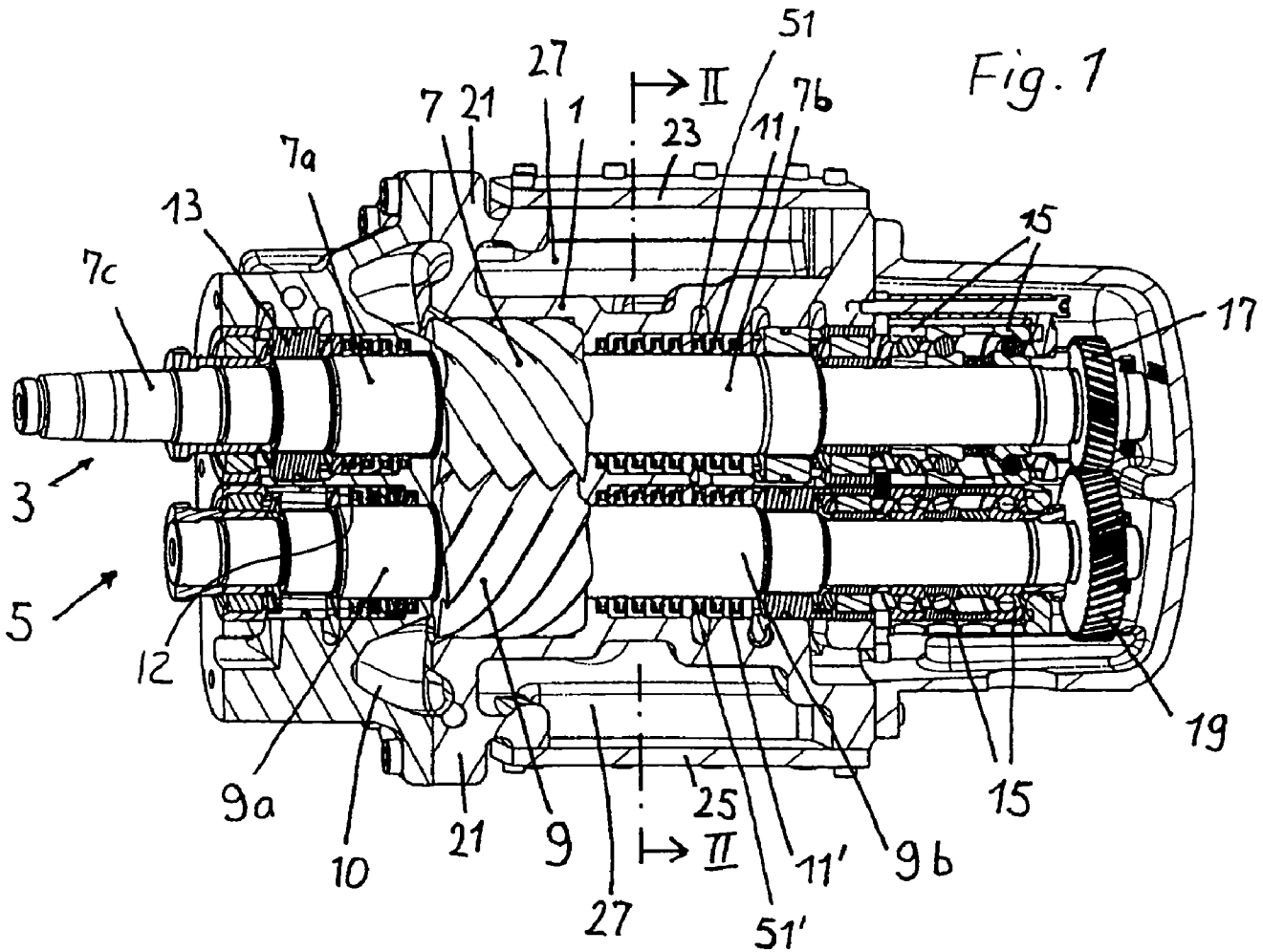
FIG. 1 a perspective, partial sectional view of the screw compressor according to one embodiment of the invention FIG. 2 a cross section of the screw compressor of FIG. 1, approximately along the sectional line II-II of FIG. 1, FIG. 3 a section essentially along line III-III of FIG. 2.

The screw compressor shown in FIG. 1 has a rotor housing 1, shown in a sectional view, in which two rotors 3 and 5 are rotatably held with parallel axes. The rotating axes of the rotors 3, 5 lie in a common vertical plane that is also the sectional plane used to illustrate the rotor housing 1. Each rotor has a profile section 7, 9 with a profile exhibiting screw-shaped ribs and grooves, wherein the ribs and grooves of the two profile sections 7, 9 mesh with one another such that a seal is created. On both sides of the profile sections 7, 9 are shaft pins 7*a*, 7*b*, 9*a*, 9*b*, the surfaces of which cooperate with seal arrangements 11, 12 to seal the rotor in the rotor housing 1. The shaft pins 7*a*, 7*b*, 9*a*, 9*b* are also rotatably held in the rotor housing 1 by bearings 13, 15.

The upper rotor 3 in FIG. 1 is the main rotor, at the left end of which in FIG. 1 is an extension 7*c* of its shaft pin provided to hold a drive gear (not shown) that meshes with a corresponding gear in a drive transmission (not shown) in order to turn the rotor 3. At the right end in FIG. 1, the two rotors 3, 5 have two gears 17, 19 that mesh with one another, thus forming a synchronization unit (synchronizing transmission) that conveys the rotation of the upper rotor 3 to the lower rotor 5, which is the secondary rotor, at the desired RPM ratio.

When the screw compressor shown in FIG. 1 is operated, the gas to be compressed, in particular air, is fed to its intake chamber 10, which is located at the left end of the profile sections 7 and 9 in the rotor housing 1 in FIG. 1 and is connected to an inlet nozzle (not shown). It is preferable if the incoming gas has already been pre-compressed to an intermediate pressure by one or more upstream compressor stages (not shown), for example a pressure in the range of 10 to 15 bar, preferably about 12 bar. This pre-compressed gas is conveyed to the right in FIG. 1 through the profile sections 7, 9 of the two rotors 3, 5 and in the process compressed to a final pressure, which is preferred to be in the range of 30 to 50 bar, in particular about 40 bar. The compressed gas leaves the rotor housing 1 through an outlet (not shown) at the right, pressurized end of the profile sections 7, 9 in FIG. 1.

Rotor housing 1 is surrounding by a cooling jacket or cooling housing 21, which is for the most part designed as one-piece together with rotor housing 1, surrounding the same at a distance. Above and below, the cooling housing 21 has large openings that are closed off using a cover plate 23 and a base plate 25 fastened with bolts. Between the rotor housing 1 and the cooling housing 21, 23, 25 is an annular cooling space 27 that surrounds the rotor housing 1.

Figure 2:
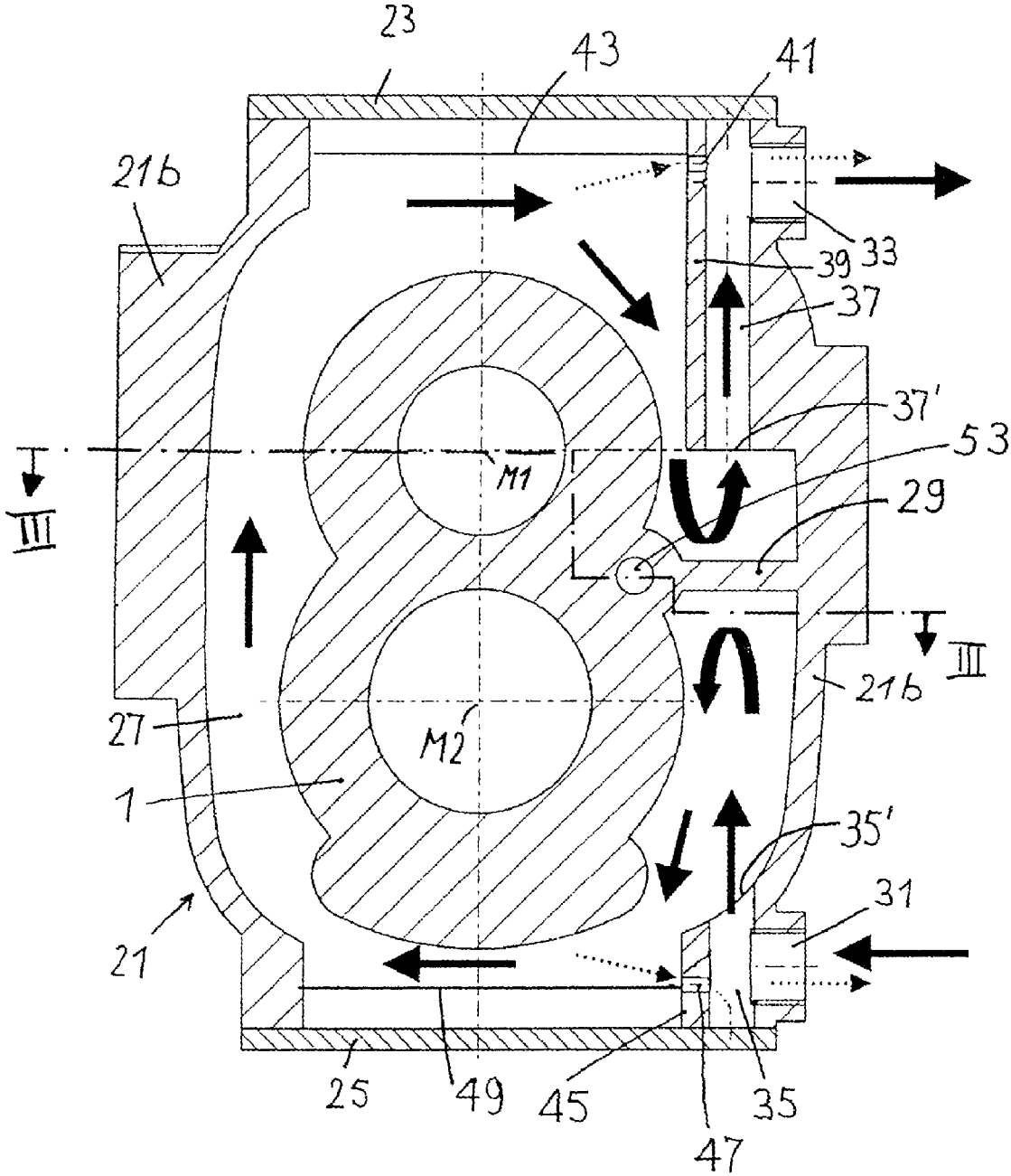

FIG. 2 shows a simplified schematic illustration of a cross section approximately along line II-II of FIG. 1. The rotor housing 1 that houses the screw rotors (not shown) is surrounded by the cooling jacket or cooling housing 21, the side walls 21*a*, 21*b* of which are preferably designed in one piece together with the rotor housing 1 and which is closed above and below by cover 23 and by base plate 25. Together with the rotor housing 1, the cooling housing 21 forms an essentially completely annular cooling chamber 27 that surrounds the rotor housing 1; this chamber is only interrupted at one point by a separating wall 29 that connects the rotor housing 1 to the side wall 21*b* of the cooling housing 21. The separating wall 29 runs horizontally approximately half way between the center points of the axes M1, M2 of the screw rotors that are arranged perpendicular one above the other.

The cooling housing 21 has an inlet opening 31 and an outlet opening 33 for coolant fluid, e.g. cooling water or oil. The inlet opening 31 opens up into a perpendicular entrance channel 35 that runs vertically upward, the upper exit opening 35' of which is situated opposite the bottom of the separating wall 29 at a distance. Prior to the outlet opening 33 is a perpendicular exit channel 37, the lower entrance opening 37' of which is situated opposite the top of the separating wall 29 at a distance.

The black arrow in FIG. 2 identifies the flow path of the coolant fed to the inlet opening 31. It is directed through the entrance channel 35 perpendicular upward toward the bottom of the separating wall 29, turns sharply away from the wall and then flows downward and around the entire periphery of the rotor housing 1, clockwise in FIG. 2, until it meets the top of the separating wall 29, where it turns sharply away from the wall upward and is withdrawn through the exit channel 37 and the outlet opening 33.

There is a small vent opening 41 in the wall 39 that separates the exit channel 37 from the cooling chamber 27 at a height that roughly corresponds to the upper edge of the outlet opening 33. While filling the cooling chamber 27 with coolant, this vent opening 41 allows air to escape, as indicated in FIG. 2 by the upper dotted arrow, so that the cooling chamber 27 can be filled up to the height of the vent opening 41, i.e. up to the fluid level indicated by line 43, and so that the volume of the included residual air above the fluid level 43 is very low.

A very small bleed opening 47 is placed in the wall 45 that separates the entrance channel 35 from the cooling chamber 27 at the level of the lower edge of the inlet opening 31. When the cooling fluid is emptied from the cooling chamber 27, cooling fluid can drain out (as indicated by the lower dotted arrow in FIG. 2) through the bleed opening 47 and the inlet opening 31 until the cooling fluid level in the cooling chamber 27 has reached the level of the bleed opening 47, i.e. until it has dropped to the level indicated by line 49. The amount of cooling fluid remaining below line 49 is therefore very low when the cooling chamber 27 is emptied.

Figure 3:
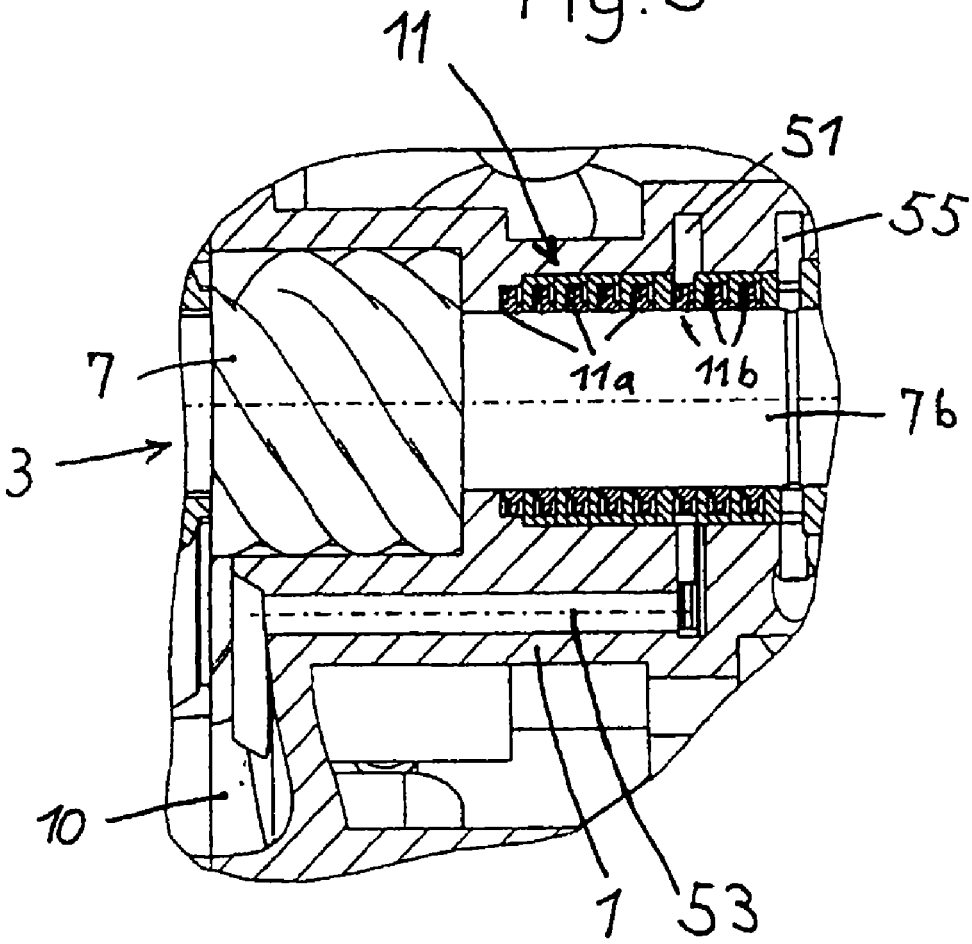

FIG. 3 shows other details of the invention that relate to the seal arrangement 11 shown in FIG. 1 to seal the shaft pins 7*b*, 9*b* of the rotors 3, 5 in the rotor housing on the pressurized side. As shown, the seal arrangement 11 consists of a number of radial seal rings 11*a*, 11*b* in series. In the embodiment shown, eight radial seal rings 11*a*, 11*b* are arranged one after the other. These radial seal rings 11*a*, 11*b* can be lip seal rings, as is preferred, and as are known from EP 0 993 553, for example. The sealing arrangement 11 is surrounded by a first annular relief chamber 51 to capture any gas that has leaked through the seals 11*a*, said chamber placed at a suitable location between a first number of radial seal rings 11*a* and a second number of radial seal rings 11*b*. In the embodiment of FIG. 3 with eight radial seal rings, it can be advantageous to place the relief chamber 51 between the first number of five radial seal rings 11*a*, seen as beginning from the rotor profile 7, and the last three, in other words the outer radial seal rings 11*b*.

The relief chamber 51 is connected to the intake chamber 10 of the screw compressor via a connection channel 53 incorporated into the rotor housing 1 running parallel to the rotor axis. The annular relief chamber 51 is thus exposed to the intake pressure of the screw compressor present in the intake chamber 10. In the preferred use of the screw compressor as a high pressure stage of a multistage compressor system, the air fed to the intake chamber 10 can have already been pre-compressed by the upstream compressor stages to a pressure of between 10 and 15 bar, for example, in particular about 12 bar. This, then, is the pressure that is present in the relief chamber 51. As the compressor is operated, the high final pressure produced by the rotors, for example 40 bar, must drop to zero through the sealing arrangement 11*a*, 11*b*. It has been shown that this pressure drop is not linear, but concentrates primarily on the outer radial seal rings 11*b* that are some distance away from the profile section 7, 9 and therefore these seals are very heavily loaded mechanically. A defined intermediate pressure is established, by way of the first relief chamber 51 being exposed to the pressure at the inlet to the compressor, at a defined point of the sealing arrangement, and thus the pressure drop along the entire sealing arrangement 11*a*, 11*b* is smoothed out. This mechanically relieves the seals 11*b*.

A second annular relief chamber 55 is provided at the far end of the sealing arrangement 11 away from the rotor. This chamber is connected to the atmosphere in a known fashion. The purpose of this second relief chamber 55 is to maintain the oil system that lubricates the bearings 15 and the synchronization gears 17, 19 at zero pressure and to prevent bleed gas from passing through the sealing arrangement 11 through to the oil-lubrication areas.

As can be seen from FIG. 1, the sealing arrangement 11' for shaft pin 9*b* of the lower rotor 5 is designed in the same manner as the sealing arrangement 11 of shaft pin 7*b* and also has an annular relief chamber 51' that is connected to the intake chamber 10 of the screw compressor through a vent channel. The vent channel 53 shown in FIGS. 2 and 3 is preferred to be a common connection channel that is connected to both relief chambers 51, 51' of the sealing arrangements 11, 11' and that connects them to the intake chamber 10.

As shown in FIG. 2, the connection channel 53 that connects relief chamber 51 to the intake chamber 10 runs inside the rotor housing 1, preferably in the direct vicinity of the separating wall 19 that connects the rotor housing 1 to the cooling housing 21. Thanks to the intensive cooling of the separating wall 29, which acts like a cooling rib, by the coolant that is redirected by it, the connecting channel, and thus the bleed gas flowing through it to the intake chamber 10, is also subjected to especially intensive cooling.

Figure 4:
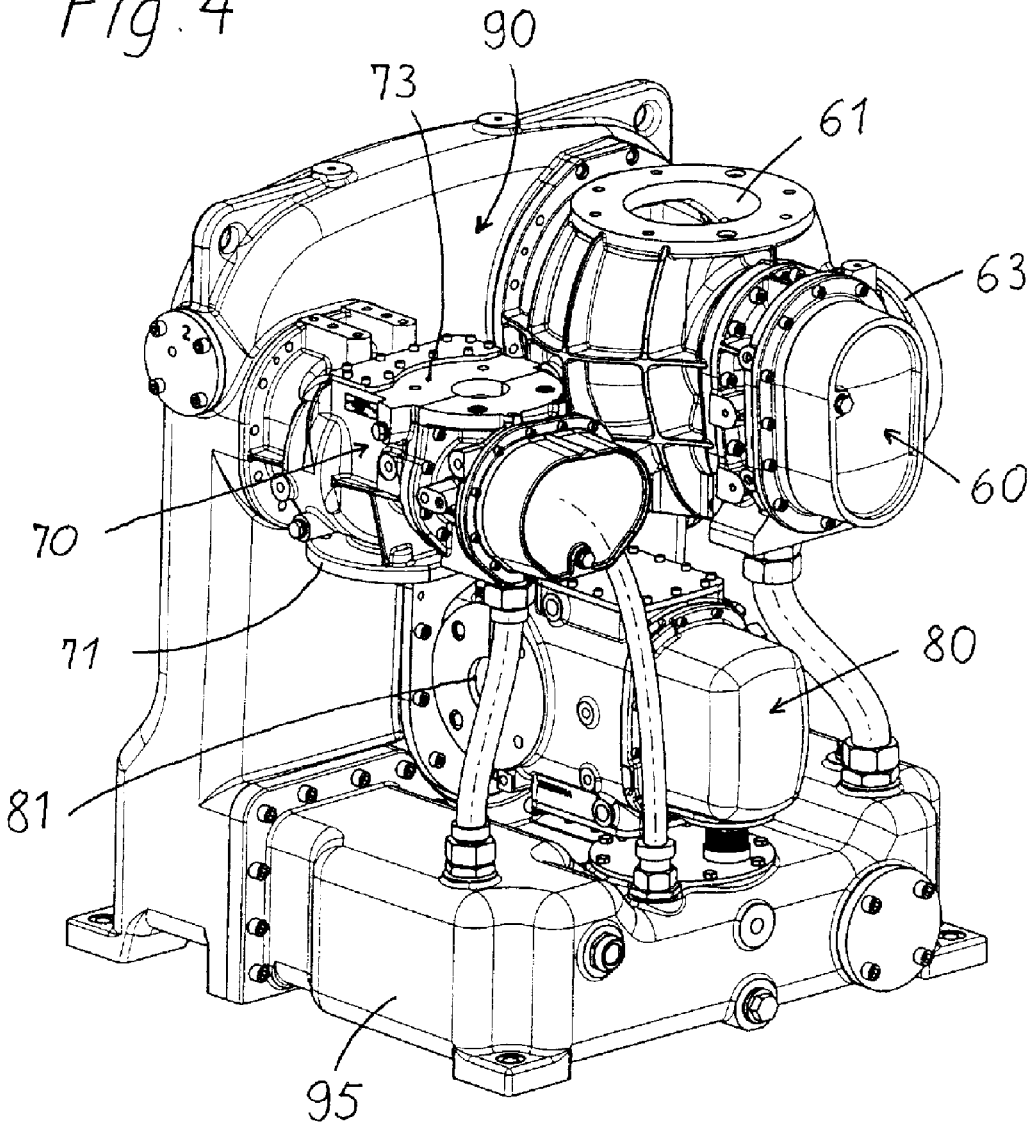
FIG. 4 a perspective representation of a three-stage screw compressor system, the third stage of which is a screw compressor according to FIG. 1.

FIG. 4 shows a perspective view of a three-stage screw compressor system with three screw compressors 60, 70, 80 that are attached to a gearbox 90 via flanges, said gearbox having essentially the shape of a perpendicular plate, and said screw compressors cantilevered parallel to one another. They are driven by a common drive gear held in the gearbox 90, said drive gear driven by a motor. This arrangement is known for two-stage compressor systems from DE 299 22 878.9 U1 and DE-A-16 28 201. In the compressor system shown, screw compressor 60 is the initial stage (low pressure stage), with inlet opening 61 and outlet opening 63, screw compressor 70 is the second or intermediate stage with inlet opening 71 and outlet opening 73, and screw compressor 80 is the final stage or high pressure stage with inlet opening 81 and an outlet opening on the side opposite the inlet opening 81 that is not shown in FIG. 4. FIG. 4 also shows an oil sump housing 95 that is flanged to the base of the gearbox 90 and that is connected to the synchronizing gears of screw compressors 60, 70, 80 and to the drive gear located in the gearbox 90.

Not shown in FIG. 4 are the connection lines for the gas to be compressed, in particular air, which connect the inlets and outlets 61, 63, 71, 73, 81 of the three screw compressors 60, 70, 80 together. These lines can be designed in the usual fashion and can be equipped with filters, intercoolers, and/or mufflers, for example.

The screw compressor 80 of the third stage is a screw compressor according to the invention according to FIGS. 1 through 3. The three-stage compressor system according to FIG. 4 is preferred to be designed such that the outlet pressure of the first stage 60 is about 3 to 6 bar, in particular about 3.5 bar, the second stage (intermediate stage) 70 produces an outlet pressure of about 10 to 15 bar, in particular about 12 bar, and the third stage (high pressure stage) produces an outlet pressure in the range of 30 to 50 bar, in particular about 40 bar. The outlet pressure produced by the second stage 70 of about 12 bar is thus the pressure present in the intake chamber 10 of the third stage 80 and thus is the pressure present in the relief chambers 51, 51' of the sealing arrangements 11, 11' for the shaft pins on the pressurized side according to FIG. 1 and FIG. 3.

What is claimed is:

1. Screw compressor with a rotor housing (1) in which two screw rotors (3, 5) are rotatably held with parallel axes, said rotors meshing into one another with screw-shaped ribs and grooves and which convey a gaseous medium during operation, from a suction-side end toward a pressurized end of the rotors, thereby compressing it, wherein each of the rotors has a shaft pin (7*a*, 7*b*, 9*a*, 9*b*) at its suction-side end and its pressure-side end, respectively, said pins being held in the rotor housing (1) by bearings (13, 15) and being sealed by respective sealing arrangements, wherein the sealing arrangement (11, 11') of each pressure-side shaft pin has an annular relief chamber (51) to which a vent channel (53) is connected, characterized in that the vent channel (53) connects the relief chamber (51) to a chamber (10) within the screw compressor in which a pressure exists during operation of the screw compressor that is higher than atmospheric pressure but lower than the outlet pressure of the screw compressor, wherein the vent channel (53) is incorporated into a wall of the rotor housing (1) that is cooled with a coolant.

2. A screw compressor according to claim 1, wherein the vent channel (53) connects the relief chamber (51) to an intake chamber (10) of the rotor housing (1), wherein the intake chamber (10) is connected to an upstream compressor stage that feeds to the intake chamber (10) a pre-compressed gas that is at a higher pressure than atmospheric pressure.

3. A screw compressor according to claim 2, wherein the intake chamber (10) is exposed to a pressure in the range of 10 to 15 bar by the upstream compressor stage, and the outlet pressure of the screw compressor is in the range of 30 to 50 bar.

4. A screw compressor according to claim 1, wherein the screw compressor is the third stage (80) of a three-stage compressor system whose first and second stages (60, 70) are also screw compressors.

5. A screw compressor according to claim 4, wherein the sealing arrangement (11, 11') of each pressure-side shaft pin contains a number of radial seal rings (11*a*, 11*b*) arranged in succession and the relief chamber (51) is provided at a point along the sealing arrangement such that the number of seal rings (11*a*) between the relief chamber (51) and the rotor profile (7, 9) is greater than the number of seal rings (11*b*) between the relief chamber (51) and the end of the shaft pin (7*a*, 9*a*).

6. A screw compressor according to claim 3, wherein the intake chamber (10) is exposed to a pressure of about 12 bar, and the outlet pressure of the screw compressor is about 40 bar.

7. Screw compressor with a rotor housing (1) in which two screw rotors (3, 5) are rotatably held with parallel axes, said rotors meshing into one another with screw-shaped ribs and grooves and which convey a gaseous medium during operation, from a suction-side end toward a pressurized end of the rotors, thereby compressing it, wherein each of the rotors has a shaft pin (7*a*, 7*b*, 9*a*, 9*b*) at its suction-side end and its pressure-side end, respectively, said pins being held in the rotor housing (1) by bearings (13, 15) and being sealed by respective sealing arrangements, wherein the sealing arrangement (11, 11') of each pressure-side shaft pin has an annular relief chamber (51) to which a vent channel (53) is connected, characterized in that the vent channel (53) connects the relief chamber (51) to a chamber (10) within the screw compressor in which a pressure exists during operation of the screw compressor that is higher than atmospheric pressure but lower than the outlet pressure of the screw compressor, wherein the sealing arrangement (11, 11') of each pressure-side shaft pin contains a number of radial seal rings (11*a*, 11*b*) arranged in succession and the relief chamber (51) is provided at a point along the sealing arrangement such that the number of seal rings (11*a*) between the relief chamber (51) and the rotor profile (7, 9) is greater than the number of seal rings (11*b*) between the relief chamber (51) and the end of the shaft pin (7*a*, 9*a*).

8. A screw compressor according to claim 7, wherein the number of seal rings (11*a*, 11*b*) is eight and the relief chamber is located between the fifth and the sixth seal ring as seen staffing from the rotor.

9. A screw compressor according to claim 7, wherein the vent channel (53) is incorporated into a wall of the rotor housing (1) that is cooled with a coolant.

10. Screw compressor with a rotor housing (1) in which two screw rotors (3, 5) are rotatably held with parallel axes, said rotors meshing into one another with screw-shaped ribs and grooves and which convey a gaseous medium during operation, from a suction-side end toward a pressurized end of the rotors, thereby compressing it, wherein each of the rotors has a shaft pin (7*a*, 7*b*, 9*a*, 9*b*) at its suction-side end and its pressure-side end, respectively, said pins being held in the rotor housing (1) by bearings (13, 15) and being sealed by respective sealing arrangements, wherein the sealing arrangement (11, 11') of each pressure-side shaft pin has an annular relief chamber (51) to which a vent channel (53) is connected, characterized in that the vent channel (53) connects the relief chamber (51) to a chamber (10) within the screw compressor in which a pressure exists during operation of the screw compressor that is higher than atmospheric pressure but lower than the outlet pressure of the screw compressor, wherein the vent channel (53) connects the relief chamber (51) to an intake chamber (10) of the rotor housing (1), wherein the intake chamber (10) is connected to an upstream compressor stage that feeds to the intake chamber (10) a pre-compressed gas that is at a higher pressure than atmospheric pressure, and wherein the screw compressor is the third stage (80) of a three-stage compressor system whose first and second stages (60, 70) are also screw compressors.

11. A screw compressor according to claim 10, wherein the sealing arrangement (11, 11') of each pressure-side shaft pin contains a number of radial seal rings (11*a*, 11*b*) arranged in succession and the relief chamber (51) is provided at a point along the sealing arrangement such that the number of seal rings (11*a*) between the relief chamber (51) and the rotor profile (7, 9) is greater than the number of seal rings (11*b*) between the relief chamber (51) and the end of the shaft pin (7*a*, 9*a*).

* * * * *

UNITED STATES PATENT AND TRADEMARK OFFICE

CERTIFICATE OF CORRECTION

PATENT NO. : 7,713,039 B2
APPLICATION NO. : 12/094388
DATED : May 11, 2010
INVENTOR(S) : Carsten Achtelik et al.

It is certified that error appears in the above-identified patent and that said Letters Patent is hereby corrected as shown below:

Title page Item [73]
The Assignee information on the face of the patent should read as follows:

GHH Rand Schraubenkompressoren GmbH, Oberhausen (DE)

Signed and Sealed this
Twelfth Day of April, 2011

David J. Kappos

David J. Kappos
*Director of the United States Patent and Trademark Office*